US011788740B2

(12) United States Patent
VanderWal

(10) Patent No.: US 11,788,740 B2
(45) Date of Patent: Oct. 17, 2023

(54) HEAT EXTRACTION WITH WATER COOLING SYSTEM

(71) Applicant: Michael A. VanderWal, Lisbon, OH (US)

(72) Inventor: Michael A. VanderWal, Lisbon, OH (US)

( * ) Notice: Subject to any disclaimer, the term of this patent is extended or adjusted under 35 U.S.C. 154(b) by 0 days.

(21) Appl. No.: 17/324,583

(22) Filed: May 19, 2021

(65) Prior Publication Data

US 2022/0373201 A1 Nov. 24, 2022

(51) Int. Cl.
*F24F 5/00* (2006.01)
*F25B 39/04* (2006.01)

(52) U.S. Cl.
CPC ..... *F24F 5/0046* (2013.01); *F25B 39/04* (2013.01); *F24F 2005/0057* (2013.01); *F25B 2339/047* (2013.01)

(58) Field of Classification Search
CPC ..... F24F 2005/0057; F24F 5/0046; F25B 2339/047; F28D 7/10; F28D 7/14; F28D 7/106; F28D 7/103; F28D 7/02; F28D 7/022; F28D 7/024; F16L 9/18
See application file for complete search history.

(56) References Cited

U.S. PATENT DOCUMENTS 3,435,627 A * 4/1969 Castillo ..... F28D 7/022 62/394
3,453,840 A * 7/1969 Koichi ..... F28F 1/06 62/515
3,477,501 A * 11/1969 Van Es ..... F28D 7/14 165/103
4,089,667 A * 5/1978 Jonsson ..... F25B 29/003 62/238.6
4,856,578 A * 8/1989 McCahill ..... F25B 13/00 62/238.7
5,802,864 A * 9/1998 Yarbrough ..... F25B 13/00 62/238.6
8,726,682 B1 * 5/2014 Olson ..... F25B 30/00 62/235.1
2001/0020786 A1 * 9/2001 Takamatsu ..... F28F 9/02 285/123.1
2004/0026070 A1 * 2/2004 Lindholm ..... F28D 7/026 165/154
2010/0126213 A1 * 5/2010 Peng ..... B01D 1/305 62/503
2013/0219942 A1 * 8/2013 Thomas ..... F24F 1/56 312/236

(Continued)

FOREIGN PATENT DOCUMENTS

DE 102016215455 A1 * 2/2018
JP 2008121925 A * 5/2008 ..... F28D 7/10

*Primary Examiner* — Tho V Duong
*Assistant Examiner* — For K Ling
(74) *Attorney, Agent, or Firm* — Daniel M. Cohn; Howard M. Cohn

(57) ABSTRACT

A device for mounting a light bulb and bulb base to a ground stake having a mounting ring for attaching a bulb and a bulb base to the ground stake. A sealing ring is disposed in the mounting ring having the bulb received in an upper end of the sealing ring and the bulb base secured to the lower end of the sealing ring whereby the sealing ring restricts moisture from flowing around the bulb and into the bulb base when the bulb is screwed into the sealing ring.

20 Claims, 5 Drawing Sheets

(56) References Cited

U.S. PATENT DOCUMENTS

| | | | | |
|---|---|---|---|---|
| 2014/0367068 | A1* | 12/2014 | Liu | F24T 10/10<br>165/45 |
| 2017/0259644 | A1* | 9/2017 | Koberstein | F24F 1/26 |
| 2018/0320801 | A1* | 11/2018 | Yang | F28F 1/06 |

* cited by examiner

HEAT EXTRACTION WITH WATER COOLING SYSTEM

TECHNICAL FIELD

The present invention relates to a device to improve the efficiency of an air conditioner and more particularly to an air conditioner using heat extraction with water to remove heat from the refrigerant.

BACKGROUND OF THE INVENTION

Vapor compression systems are employed in most refrigerated air conditioning systems. Cooling is accomplished by evaporation of a liquid refrigerant under reduced pressure and temperature. The refrigerant vapor enters the compressor where the temperature is elevated by mechanical compression. The vapor condenses under pressure in a condenser coil to form a high-pressure liquid refrigerant. The high-pressure liquid refrigerant then passes through an expansion valve where the fluid pressure of the refrigerant is reduced. The low-pressure refrigerant next enters an evaporator where the refrigerant evaporates by absorbing heat from the space being cooled and then reenters the compressor to start the cycle again.

Most residential central air conditioning units are split systems comprising a condensing coil, a refrigerant compressor and a fan located outside the home, and an expansion valve and a refrigerant evaporator coil, that is usually part of a furnace or air handler, inside the home. The air handler of the furnace blows air across the evaporator coil, which cools the air. The cool air is routed through a series of air ducts into spaces in the home to be cooled.

The compressor, usually controlled by a thermostat, acts as a pump that moves the refrigerant from the indoor evaporator to the outdoor condenser and back to the evaporator again, causing the refrigerant to flow through the system. The compressor draws in low-pressure, low-temperature, refrigerant in a gaseous state and by compressing this gas, raises the pressure and temperature of the refrigerant. This high-pressure, high-temperature gas then flows to a condenser.

The condenser unit normally located outside the home, is a device that transfers unwanted heat out of the cooling system. The condenser coil is usually formed by a series or network of aluminum-finned copper tubes filled with refrigerant that removes heat from the hot, gaseous refrigerant so that the refrigerant becomes liquid again.

The evaporator coil is a series of piping connected to a furnace or air handler that blows indoor air across the evaporator coil, causing the evaporator coil to absorb heat from the air. The cooled air is then delivered to the home through ducting. The refrigerant from the evaporator coil flows back to the compressor where the cycle is repeated.

The cooling capacity of the air conditioner is a measure of the ability of a unit to remove heat from an enclosed space. A long felt need exists for a condensing unit that efficiently removes heat from the system under a variety of operating conditions.

There are three basic types of condensers: air-cooled condensers, water-cooled condensers, and evaporative condensers. Most residential systems use an air-cooled condenser. A fan typically draws outside air across the condenser coil of an air-cooled condenser. As the refrigerant passes through the condenser coil and the cooler outside air passes across the coil, the air absorbs heat from the refrigerant which causes the refrigerant to condense from a gas to a liquid state. The high-pressure, high-temperature liquid then reaches the expansion valve. The liquid flows through a very small orifice in the expansion valve, which causes the refrigerant to expand to a low-pressure, low-temperature gas that flows to the evaporator.

In hot regions of the country, the low temperature gradient between hot ambient air moving across the condenser coil and the hot refrigerant vapor flowing through the condenser coil prevent dissipation of enough heat which causes the system to operate at less than optimum efficiency. The compressor in the inadequately cooled system draws excessive electrical current, wasting electricity and increasing the operating cost of the system. Further, the cooling capacity of the system is sometimes inadequate to maintain the desired temperature in an enclosed space.

SUMMARY OF THE INVENTION

According to the present invention, there is disclosed a Heat Extraction with Water (HEW) cooling system for cooling room air of a building that maximizes the amount of heat that transfers out of a hot refrigerant to outside air. The HEW cooling system comprises a self-contained, condenser unit including a compressor, an HEW condenser tube, and a water pump to circulate cool underground water around the HEW condenser tube. A first flow line between the compressor and the building directs cooled refrigerant to an evaporator tube within the house. A second flow line directs heated refrigerant to the compressor. A third flow line directs heated, compressed refrigerant to a refrigerant flow line in a water jacket.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
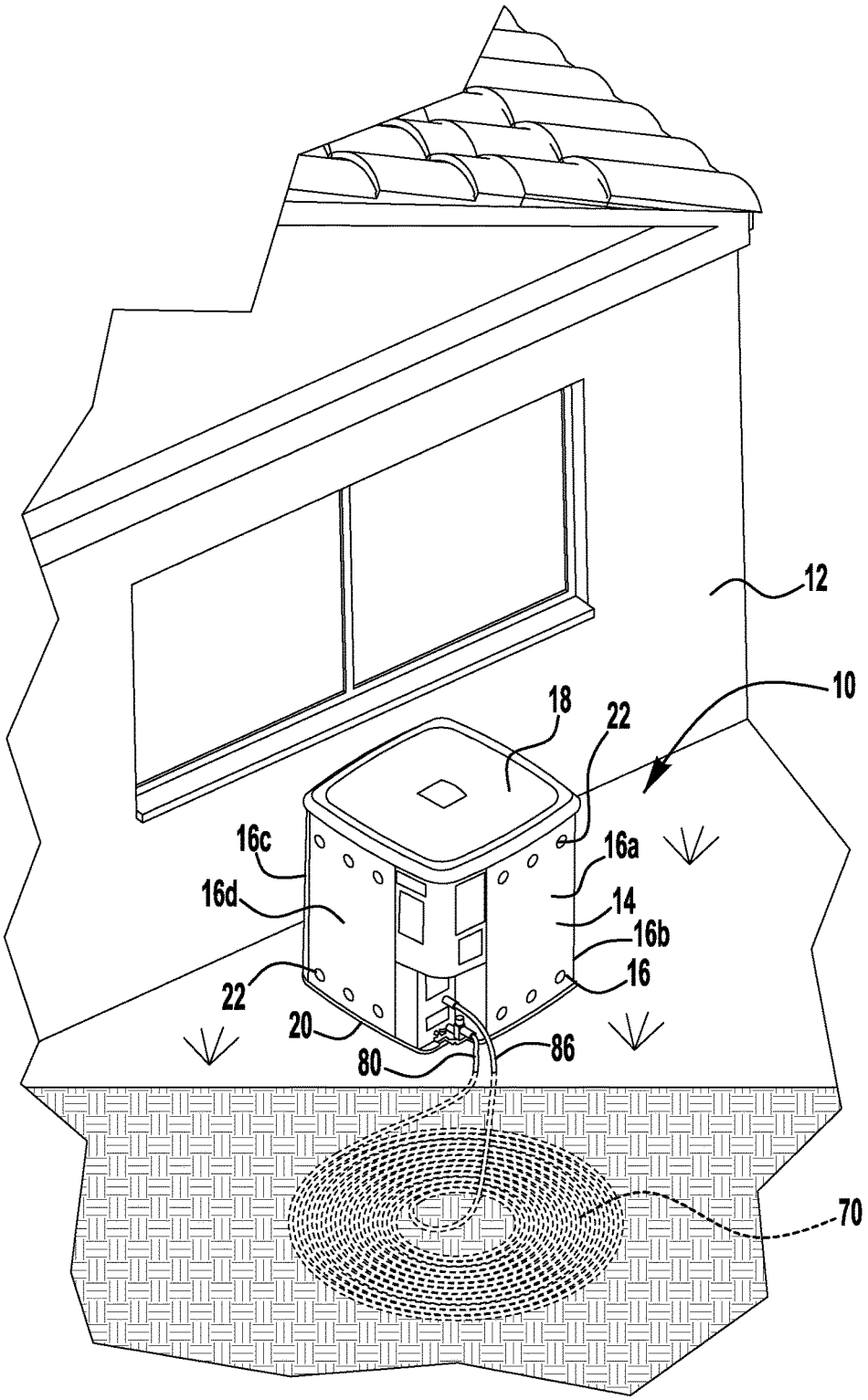
FIG. 1 is a three-dimensional view of a building with an air conditioning unit located outside and an adjacent underground coil connected to the unit, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

Current air-conditioning systems have a low efficiency (65% maximum) due to insufficient surface area of the heat transfer materials, too short of a transfer time of the heat, and ever increasing adverse environmental conditions that slow heat transfer enough to stop the cooling process.

The present invention is directed to a Heat Extraction With Water (HEW) cooling system 10 that maximizes the amount of heat that transfers out of the hot refrigerant to the outside air by nearly doubling the amount of surface area available for heat transfer. This change not only increases the amount of heat removed from the refrigerant over time but speeds up the amount of heat transferred per second.

Typical air-conditioners operate by removing heat from the inside of a building and transferring the heat to the outside of the building. A heat transfer medium called a refrigerant collects the B.T.U.'s of energy (the heat) by passing the cold refrigerant through a thin walled metal tube called the evaporator, that is exposed to the hot room air. The refrigerant gets compressed and passes through another thin walled metal tube that is exposed to the outside air. This condenser tube transfer some of the heat in the refrigerant to the outside air then returns to the evaporator to pick up more heat in the room. This process has severe limitations that is common to all air conditioners. The heat transfer takes time. This results in the refrigerant having to cycle through the system hundreds of times each hour in order to remove enough heat to satisfy the cooling requirements.

With the present invention, as the refrigerant flows through the condenser, it only requires a shorter amount of time to transfer the heat from the refrigerant before the next quantity of refrigerant flows through the condenser. This can be compared to current systems where the transfer of heat is to the outside air resulting in the amount of heat transfer being dependent upon the weather conditions on any particular day. The higher the temperature of the outside air, the slower the heat transfer. In addition, as the humidity of the outside air increases, the speed of heat transfer decreases. Also, if the outside air is still, a blanket of heat surrounds the condenser tubes and thereby blocks heat transfer.

As discussed in more detail below, the hot environmental air has been replaced with cool water. The cool water extracts more heat and does it more quickly than environmental air. The end result is that the refrigerant is colder so that it picks up more heat from the room with a resulting increased efficiency.

The Heat Extraction With Water (HEW) cooling system 10 of the present invention increases the heat transfer in three different ways. First, the condenser tube 36 has been re-designed to approximately double the amount of surface area available for heat transfer as compared with condenser tubes of the prior art. Second, a water supply located underground surrounds part of the condenser tube for more efficiently transferring heat from the refrigerant flowing through the condenser tube. This increase in heat transfer lowers the refrigerant's temperature which results in an increase in the refrigerant's ability to pick up heat from the space which is being air conditioned. Third, cool water at an approximate constant temperature from underground surrounds the condenser tube, providing an environment free of excess heat and humidity. Thus, the best conditions can be provided for heat transfer.

The HEW cooling system uses two heat extractions to remove additional heat from the refrigerant resulting in a significant increase in cooling capacity. This increase is large enough that the HEW cooling system can replace three, four and five ton central air-conditioning systems. It also provides a significant increase in energy efficiency. The energy efficiency rating, (E.E.R.), universally used on air-conditioners is a number that specifies how many B.T.U.'s of cooling (B.T.U.s of heat removed equal B.T.U.'s of cooling) the air-conditioner will produce for each watt of electricity used to produce the cooling. Current air-conditioner systems are limited to 10.45 B.T.U. of cooling per watt used. The HEW cooling system will produce 15 or more B.T.U.s of cooling per watt used.

The HEW cooling system 10, as shown in FIG. 1, includes a self-contained, condenser unit 14, which has a cube-like shape and is typically constructed of a metal case with dimensions similar to typical central air conditioning units. Inside the metal case 11, as shown in FIG. 2, is a compressor 28, such as for example a three-horsepower compressor, an HEW condenser tube 36, and a water pump 26 to circulate cool underground water around the HEW condenser tube.

As shown in FIG. 1, cooling system 10 is used for cooling a building 12, such as for example a house. The condenser unit 14, as shown in FIG. 2, can be of any desired size, such as for example 36 inches by 36 inches by 28 inches and is formed with a plurality of side panels 16 (16*a*, 16*b*, 16*c*, 16*d*) a top panel 18 and a bottom panel 20. There can be a series of holes 22 which extend along the upper and lower end of each of the side panels 16*a*-16*d*. The holes 22 can have a diameter of between ⅜ inches and ⅝ inches and preferably about ½ inch. An electrical service line capable of about 3000 watts per hour is connected to a water pump 26, such as for example a ½ horsepower water pump, housed within the condenser unit 14. A three horsepower compressor 28 is also housed within the condenser unit 14.

Figure 2:
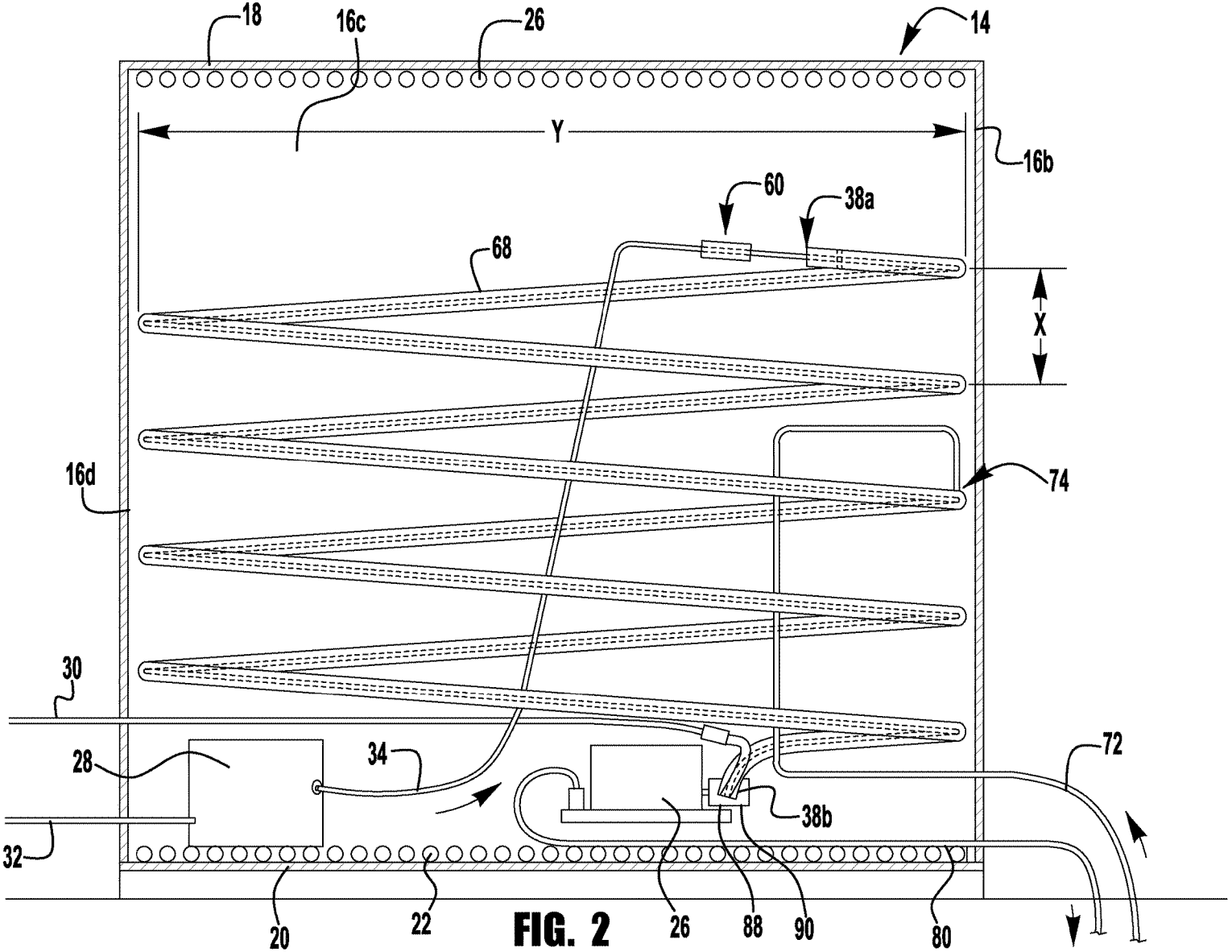
FIG. 2 is a side, cross-sectional view of the air conditioning unit shown in FIG. 1, in accordance with the present invention.

As shown in FIG. 2, the compressor 28 is connected by a first flow line 30 to the house 12. The first flow line 30 directs cooled refrigerant to the house 12 that then enters the evaporator tube within an airduct of the house to pick up more B.T.U.'s of heat from the room air. A second flow line 32 returns heated refrigerant that has been warmed in the house 12 back to the compressor 28. A third flow line 34, having a circular cross section, directs heated, compressed refrigerant to the metal connector 60, that changes the flow line from circular to square and emerges into line 68 which interconnects with condenser 36 in the water jacket 38.

Figure 5:
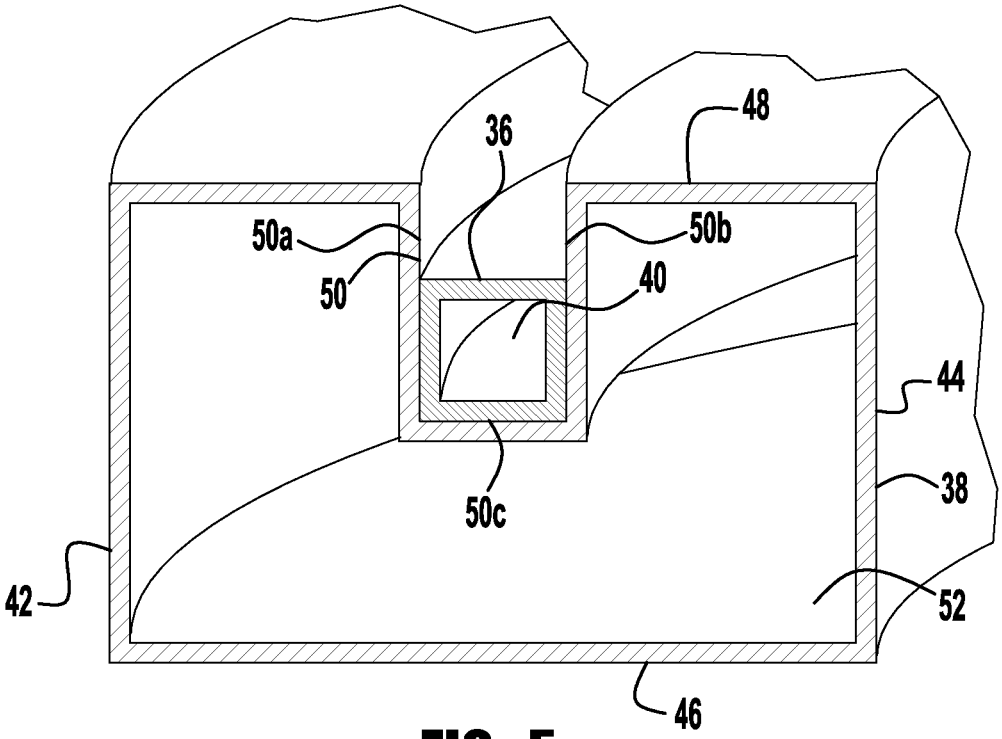
FIG. 5 is a side, cross sectional view of a condenser tube disposed in a waster jacket, in accordance with the present invention.

The water jacket 38, as shown in FIG. 5, has a generally rectangular shaped cross section with first and second side walls 42 and 44, a bottom wall 46 and a top wall 48 having a rectangular opening 50 formed therein and extending the length of the water jacket. The water jacket 38 has a spiral shape and is contained within the condenser unit 14 between the top panel 18 and the bottom panel 20.

The rectangular opening 50 is formed with opposite facing sidewalls 50*a* and 50*b* and a bottom wall 50*c*. The H.E.W. square flow line 36 is pressed into this opening to form the structure in FIG. 5. The large opening will eventually be filled with water with a volume of approximately 0.45 square inches ad the small opening is filled with refrigerant that transfers it's heat to the very large surface area of the water jacket 38 and later to the water within the water jacket. The entire structure of FIG. 5 forms a continuous length of flow line that extends from 38a to 38*b* and is comprised of four (4) full circles of flow line, plus a partial circle at both the beginning 38*a* and the end 38*b*. The flowline circles are 34.5 inches in diameter and are spaced five (5) inches apart to form a single inclined spiral.

The combined H.E.W. square condenser water jacket unit separates prior to reaching the water pump 26. The square H.E.W. condenser transitions back to the round shaped condenser tube 34 using the connector 60 from FIG. 7 and then returns the cool refrigerant back to house 12.

Figure 8:
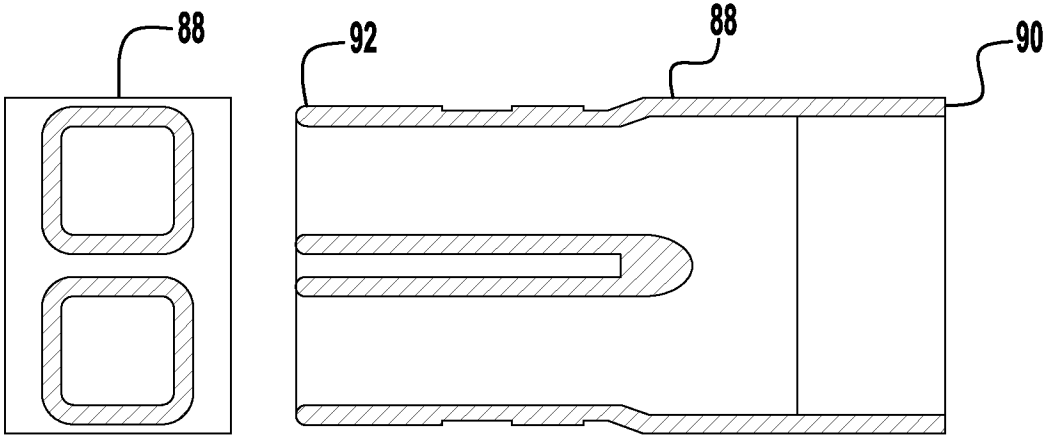
FIG. 8 is a side, cross sectional view of a connector adapted to interconnect a water jacket to a plastic condenser tube, in accordance with the present invention.

The metal connector 88 from FIG. 8 gets soldered to the first end opening 90 of the water jacket 38. The opposite end opening 92 the metal connector 88 of FIG. 8 is formed into flanges that fit into both water channels of the underground plastic tubing. Another metal connector, this one has one end that screws into the female threads of the water pump that accepts water inbound. The other end of this connector has the same flanges that fit the water channels of the plastic tubing an either metal or nylon clamps will provide leak proof connections.

Water from the underground plastic tubing spiral returns to the condenser cabinet 10. Once inside the cabinet, the dual plastic waterlines transition to a single water line 74 that travels vertically and enters the water jacket of the unified spiral H.E.W. condenser at the beginning of the third circular loop. The plastic water line enters a hole drilled into dry water jacket and then extends nine (9) inches so that water enters and fills the water jacket until 38*b*. This keeps the top of the water level in the water jacket well below the hole itself. This volume of water will take the water pump approximately thirty (30) seconds to replace, which means the water will pick up heat (B.T.U.s energy) for thirty seconds before being pumped underground for heat transfer to the ground, lasting for two full minutes before returning above ground.

After the H.E.W. condenser flow line separates from the water jacket at 38*b*, the metal connector from FIG. 8 having a large end with a slightly larger opening than the water jacket 50, (and without the square H.E.W. condenser), so the water jacket can fit into the large end and be soldered together. The other end of the connector of FIG. 8 has the same two (2) flanges for insertion into the water channels of a piece of the underground tubing. The other end of the small length of tubing gets connected to the inlet of a round to square connector similar to the connector shown in FIG. 7. The connector has a through bore with a circular cross section at a first end portion of the connector and a square cross section at a second end portion of the connector. The other end of the connector has a threaded end of either a 0.75 inch pipe or a 0.5 inch pipe depending on the size needed for the water pump. Once again, two metal or nylon straps attach snugly to the end of the plastic tubing after the metal flanges have been inserted into the water channels of the plastic tubing.

Figure 7:
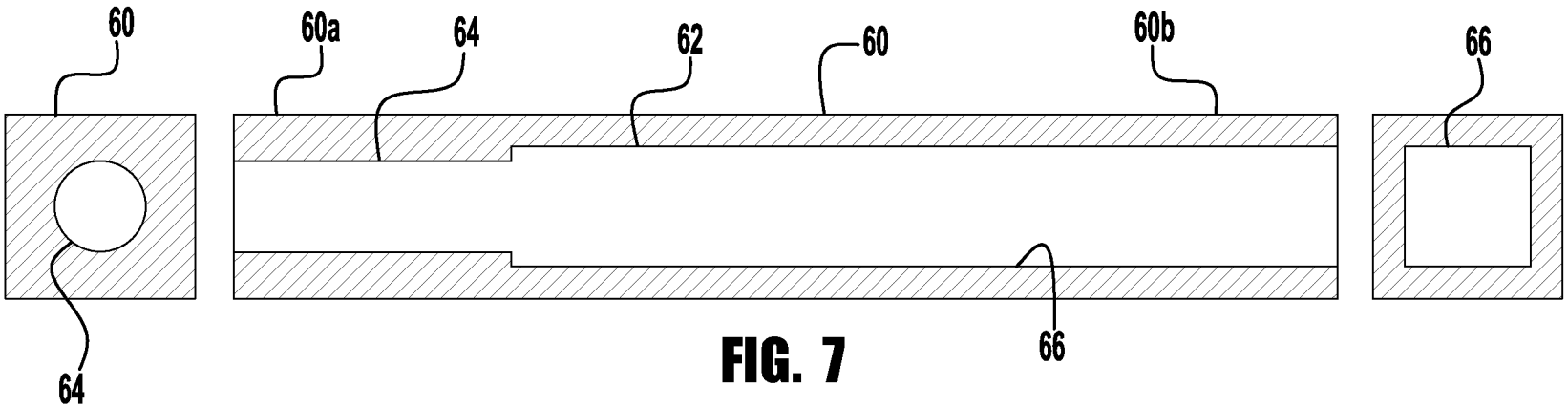
FIG. 7 is a side, cross sectional view of a connector adapted to interconnect a round condenser tube and a square condenser tube, in accordance with the present invention.

Referring to FIGS. 2 and 7, there is illustrated a round to square connector 60 having a through bore 62 which has a circular cross section 64 at a first end portion 60*a* of the connector 60 and a square cross section 66 at a second end portion 60*b* of the connector 60. The circular cross section 64 at the end portion 34*a* of the third flow line 34, having a circular cross section, which directs hot refrigerant from the compressor 28 to the inlet 36*a* of the condenser tube 36.

The square end 66 of connector 60 in FIG. 7 connects to the square H.E.W. condenser 36, while the round end 64 of connector 60 connects directly to the round condenser line that returns to the house. Solder all joints to maintain pressure of the system.

The water jacket 38 has a circular spiral shape with a diameter Y of about 34.5 inches. The distance x between the circular loops 38 is about 5.0 inches. As shown in FIG. 2, the water jacket has 4½ loops. The length of the condenser tube 36 is about 40 to 41 feet and is preferably formed with 4½ loops from the inlet 36*a* located adjacent to the first end 38*a* of the water jacket to the second end 38*b*.

All of the connectors, such as round to square connector 60, can be made from metal, such as aluminum alloy A390. All of the metal-to-metal connections can be soldered. The metal to plastic connections are designed for pressure fittings, using multiple nylon or wire ties.

Figure 3:
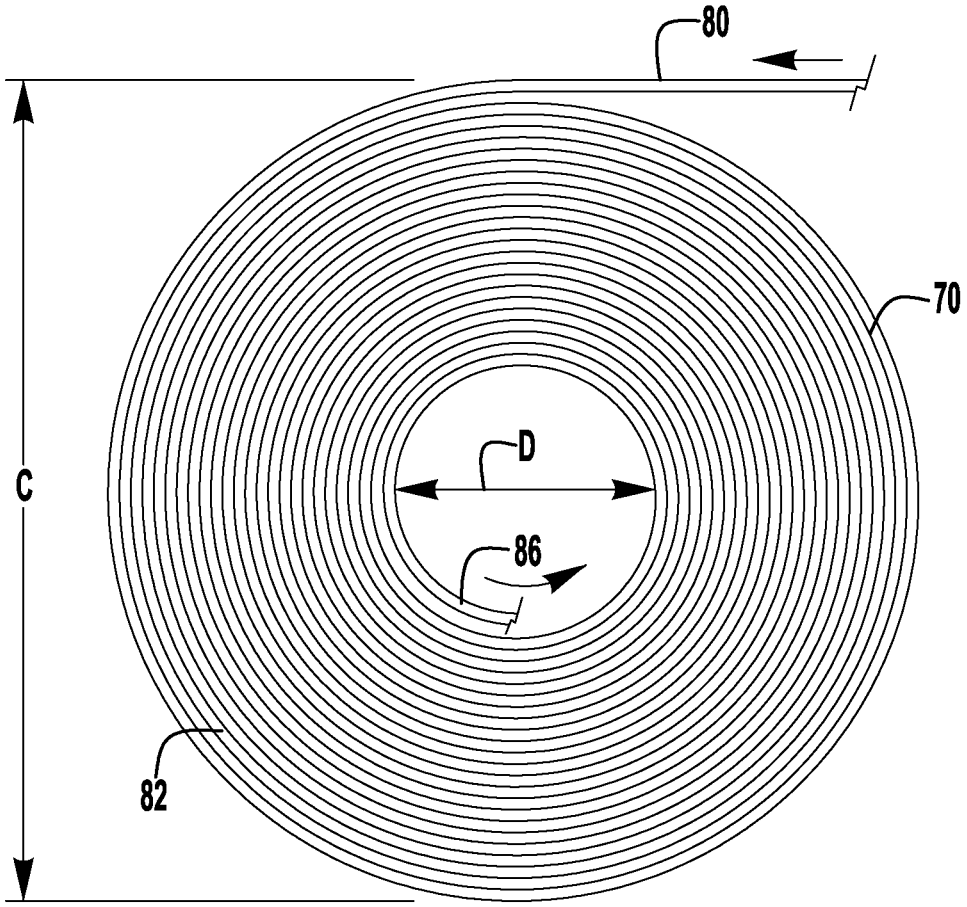
FIG. 3 is a top view of a coil disposed underground, in accordance with the present invention.
Figure 4:
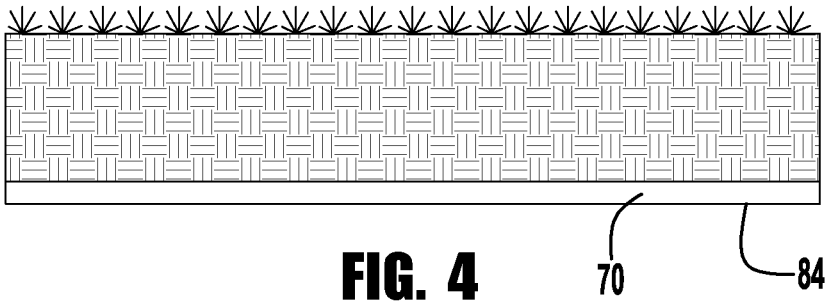
FIG. 4 is a side view of the underground coil shown in FIG. 3, in accordance with the present invention.
Figure 6:
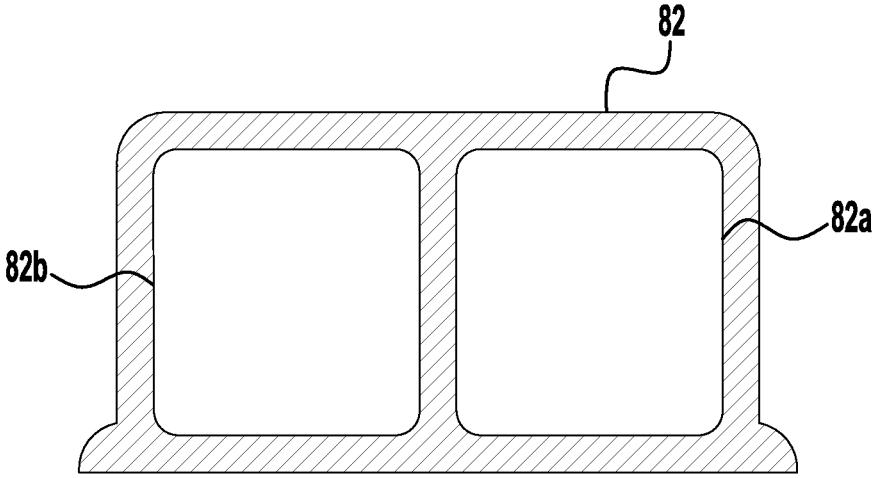
FIG. 6 is a side, cross sectional view of the underground tubing, in accordance with the present invention.

The pump 26 directs warm water from the water jacket 38 to an underground cooling field 70 as shown in FIGS. 1 and 3. The warm water line 80 is constructed of flexible, dual channel plastic piping 82, as shown in FIG. 6, that is placed underground as shown in FIGS. 3 and 4. The flexible, dual channel piping 82 is flexible enough that it can form a 12 inch diameter circle D. The piping 82 can be formed into a continuous spiral having a diameter C of about 48 inches. The continuous spiral of piping 82 can be placed in a flat, bottomed excavation 84. The line 80 from condenser unit 14 to the continuous spiral of piping 82 can be about 10 feet long. The line 86 from the continuous spiral of piping 82 to the condenser unit 14 can be about 10 feet long.

The flat, bottomed excavation 84 can be an area of about 50 inches by 50 inches. The depth of the excavation is a minimum of 12 inches. However, the depth may go below the frost line. The bottom surface of the excavation 84 is flat to provide for optimal water flow. The advantage of placing the continuous spiral of piping 82 in the excavation 84 is that the ground provides for virtually unlimited heat dispersal. There are virtually no adverse environmental conditions that the piping 82 has to contend with.

Referring to FIG. 6, there is illustrated a cross-sectional view of the flexible piping 82 having two flow lines 82*a* and 82*b* to carry more flow of water to be cooled through the cooling field 70.

Referring to FIG. 8, there is illustrated a connector 88 which connects at one end 90 to the end 38*b* of the water jacket 38. The opposite end 92 of the connector 88 is connected to the pump 26 which directs the water cooling the water jacket 38 into the line 80 which has two adjacent flow passages that are inserted into the end 92 of the connector 88.

The mathematics of cooling. One ton of ice will absorb 12,000 B.T.U's (British Thermal Units) of heat as it melts. Each pound of refrigerant ($R^0$) theoretically is designed to remove 12,000 B.T.U's of heat every hour.

This means that a modern home's three ton air conditioning system should remove 3 tons×12,000 B.T.U's every hour. However design on all A/C systems only produce 65% of the cooling B.T.U's, 36,000 B.T.U's×65%=23400 B.T.U's.

Another way of determining the amount of heat removed (B.T.U's) is to understand that if air conditioners were 100% efficient, each pound of refrigerant would remove 12,000 B.T.U's of heat every hour. A three ton A/C uses three pounds of refrigerant, which would produce 3 lbs. $R^0$×12,000 B.T.U's per pound=36,000 B.T.U's removed. This means that every pound of refrigerant picks up 20 B.T.U's of heat on every one of the ten (10) trips through the system every minute. 20 B.T.U's×10 trips×3 pounds $R^0$×60 minutes=36,000 B.T.U's per hour.

But all air-conditioners only pick up 65% of these 20 B.T.U.'s which means 20 B.T.U.'s×65%=13 B.T.U.'s of heat pick up each trip. 13 B.T.U's×ten trips×1 pounds $R^0$×60 minutes=7800 B.T.U's per hour. A three ton system uses three (3) pounds of refrigerant producing 1 lb. $R^0$=7800 B.T.U's×3 pounds $R^0$=23,400 B.T.U.'s of cooling per hour.

This limitation of picking up only 13 B.T.U.'s of heat each trip (or less) stays the same regardless of the size of the A/C system.

A 3 ton system use 3 lbs. $R^0$ at 7800 BTU/pound=23,400 B.T.U.'s/hr.

A 4 ton system use 4 lbs. $R^0$ at 7800 BTU/pound=31,200 B.T.U.'s/hr.

A 5 ton system use 5 lbs. $R^0$ at 7800 BTU/pound=39,000 B.T.U.'s/hr.

A 50 ton system use 50 lbs. $R^0$ at 7800 BTU/pound=390,000 B.T.U.'s/hr.

The H.E.W. system 10 extracts more heat out of the refrigerant before it expands, which makes each molecule of the refrigerant much colder, and therefore picks up many more B.T.U.'s from the room air before cycling through the system, 22 B.T.U.'s per pound $R^0$.

22 B.T.U.'s picked up per pound×use 3 lbs. $R^0$×10 trips×60 minutes=13,200 B.T.U.'s per hour. 3 ton system uses 3 pounds of refrigerant, at 22 B.T.U.'s per trip. 22 B.T.U.'s×3 pounds $R^0$.×10 trips×60 minutes=39,600 B.T.U.'s cooling/hour.

Energy Efficient Rating (E.E.R.) This rating is the number of B.T.U.'s of heat removed from the air (that we feel as the cooling effect), for each watt of electrical energy used to produce the cooling.

Every horsepower a motor uses takes 746 watts per hour.

3 ton systems use 3 Hp motors at 746 watt per Hp=2238 watts per hour.

4 ton systems use 4 Hp motors at 746 watt per Hp=2984 watts per hour.

5 ton systems use 5 Hp motors at 746 watt per Hp=3730 watts per hour.

3 ton A/C make 23,400 B.T.U.'s/hr, divided by 2238 watts=10.46 B.T.U.'s per watt.

4 ton A/C make 31,200 B.T.U.'s/hr, divided by 2984 watts=10.46 B.T.U.'s per watt.

5 ton A/C make 39,000 B.T.U.'s/hr, divided by 3730 watts=10.46 B.T.U.'s per watt.

The H.E.W.'s system 10 has an E.E.R. of 15.17 B.T.U's per watt producing 39,600 B.T.U.'s of cooling using 2611 watts per hour.

The present invention has been described in detail above with reference to the embodiments of the drawings, and various modifications of the present invention can be made by those skilled in the art in light of the above description. Any modification within the spirit and principle of the present invention, made, equivalent substitutions, improvements, etc., should be included within the scope of the present invention. Thus, certain details of the embodiments should not be construed as limiting the present invention, the present invention will define the scope of the claims appended as the scope of the present invention.

The invention claimed is:

1. A Heat Extraction with Water (HEW) cooling system for cooling room air of a building that maximizes the amount of heat that transfers out of a hot refrigerant to outside air, comprising:

- a self-contained, condenser unit including a compressor, an HEW condenser tube, and a water pump to circulate cool underground water in a water jacket and around the HEW condenser tube;
- a first flow line between the condenser unit and the building for directing cooled refrigerant to an evaporator tube within the building;
- a second flow line for directing heated refrigerant to the compressor;
- a third flow line for directing heated, compressed refrigerant to a metal connector that changes the third flow line from round to square and emerges into a line which interconnects the HEW condenser tube in the water jacket; and
- a single water line that travels vertically and enters the water jacket at the beginning of a third circular loop where the single water line enters a hole in the water jacket and fills the water jacket to keep the water level in the water jacket below the hole itself.

2. The HEW cooling system of claim 1 wherein the condenser unit is formed with a plurality of side panels, a top panel and a bottom panel.

3. The HEW cooling system of claim 2 including a series of holes extend along an upper and lower ends of each of the side panels.

4. The HEW cooling system of claim 3 wherein an electrical service line capable of about 3000 watts is connected to the water pump housed within the condenser unit.

5. The HEW cooling system of claim 1 wherein the compressor is connected by the first flow line to the evaporator tube within an airduct in the building to pick up B.T.U.'s of heat from the room air.

6. The HEW cooling system of claim 5 wherein the second flow line returns heated refrigerant that has been warmed in the building back to the compressor.

7. The HEW cooling system of claim 6 wherein the third flow line directs the heated, compressed refrigerant to the connector that connects with the HEW condenser tube in the water jacket.

8. The HEW cooling system of claim 7 wherein the water jacket has a generally rectangular shaped cross section with first and second side walls, a bottom wall and a top wall having a rectangular opening formed therein and extending the length of the water jacket.

9. The HEW cooling system of claim 8 wherein the water jacket has a spiral shape and is contained within the condenser unit between the top wall and the bottom wall.

10. The HEW cooling system of claim 9 wherein the water jacket has the rectangular opening formed with opposite facing sidewalls and a bottom wall and the HEW condenser tube is pressed into this rectangular opening.

11. The HEW cooling system of claim 10 wherein the water jacket is comprised of four full circles of the HEW condenser tube, plus a partial circle of the refrigerant flow line at both the beginning and the end of the full circles of refrigerant flow line.

12. The HEW cooling system of claim 11 wherein the HEW condenser tube separates from the water jacket prior to reaching the water pump and then returns cooled refrigerant back to the building through the first flow line.

13. The HEW cooling system of claim 10 further including an underground cooling field constructed of dual channel plastic piping.

14. The HEW cooling system of claim 13 further wherein the dual channel plastic piping is formed into a continuous spiral of piping having a diameter placed in a flat, bottomed underground excavation.

15. The HEW cooling system of claim 14 further wherein the continuous spiral of piping is connected by a line to the condenser unit.

16. The HEW cooling system of claim 15 further wherein: the dual channel plastic piping returns to the condenser unit and transitions to the single water line that travels vertically and enters the water jacket of the condenser at the beginning of the third circular loop.

17. The HEW cooling system of claim 16 wherein the single water line enters the hole in a dry section of the water jacket so that water enters and fills the water jacket so that the water line in the water jacket is below the hole itself.

18. The HEW cooling system of claim 15 wherein:

the metal connector has a through bore which has a circular cross section at a first end portion of the connector and a square cross section at a second end portion of the connector; and the metal connector has a circular cross section at the first end portion of the third flow line to direct warmed refrigerant from the compressor to the inlet of the HEW condenser tube.

19. The HEW cooling system of claim 18 wherein a connector line having a square cross section connects the second end portion of the metal connector to one end of the connector line and an opposite end of the connector line being connected to the end of the HEW condenser tube located near the end of the water jacket.

20. The HEW cooling system of claim 19 wherein the length of the HEW condenser tube is about 40 to 41 feet and is formed with 4½ loops from the inlet located adjacent to the first end of the water jacket to the second end.

* * * * *